US011427389B2

(12) United States Patent
Chin

(10) Patent No.: US 11,427,389 B2
(45) Date of Patent: Aug. 30, 2022

(54) COMPARTMENT FOR PREPARATION AS BOTTLE CAP OF DRINKING WATER

(71) Applicant: Ivan Chin, Singapore (SG)

(72) Inventor: Ivan Chin, Singapore (SG)

(73) Assignee: Ivan Chin, Singapore (SG)

( * ) Notice: Subject to any disclaimer, the term of this patent is extended or adjusted under 35 U.S.C. 154(b) by 0 days.

(21) Appl. No.: 16/582,373

(22) Filed: Sep. 25, 2019

(65) Prior Publication Data

US 2020/0031543 A1 Jan. 30, 2020

(30) Foreign Application Priority Data

Jul. 25, 2018 (ID) ..... SID201805578

(51) Int. Cl.

| | |
|---|---|
| ***B65D 51/28*** | (2006.01) |
| ***B65D 81/32*** | (2006.01) |
| ***B65D 85/72*** | (2006.01) |
| ***B65D 55/06*** | (2006.01) |

(52) U.S. Cl.

CPC ..... *B65D 51/28* (2013.01); *B65D 55/06* (2013.01); *B65D 81/32* (2013.01); *B65D 85/72* (2013.01)

(58) Field of Classification Search

CPC ..... B65D 51/2828; B65D 51/2814; B65D 51/2807; B65D 51/2835; B65D 51/28; B65D 25/085; B65D 81/325

USPC ..... 206/222, 219

See application file for complete search history.

(56) References Cited

U.S. PATENT DOCUMENTS

| | | | | | |
|---|---|---|---|---|---|
| 5,839,573 | A * | 11/1998 | Morini | B65D 51/2864 | 206/221 |
| 5,890,700 | A * | 4/1999 | Clarkson | F16K 3/0281 | 251/327 |
| 5,950,819 | A * | 9/1999 | Sellars | B65D 51/2885 | 206/221 |
| 8,590,700 | B2 * | 11/2013 | Yang | B65D 47/141 | 206/222 |
| 8,672,154 | B2 * | 3/2014 | Seelhofer | B65D 51/2821 | 215/227 |
| 9,132,950 | B1 * | 9/2015 | Anderson | B65D 81/32 | |
| 2010/0200437 | A1 * | 8/2010 | Coon | B65D 25/085 | 206/222 |

(Continued)

FOREIGN PATENT DOCUMENTS

| | | | |
|---|---|---|---|
| WO | WO0201203625 | A | 3/2013 |
| WO | WO0201202173 | A | 10/2013 |

*Primary Examiner* — Steven A. Reynolds

(74) *Attorney, Agent, or Firm* — JCIP; Joseph G. Chu; Jeremy I. Maynard

(57) ABSTRACT

Present invention provides a compartment as bottled beverages cap for a formula of liquid or powder preparation which may be mixed-up easily with beverages inside of another bottle into a liquid composition. The user simply changes bottle beverage cap with a compartment according to present invention, expel the content into bottle with tear-off mechanism thus the content is mixed-up with water inside of bottle, and creates a ready-to-drink liquid composition. Further present invention provides a breaker having a stopper to against unintentional movements, specifically due to user's accidentally movement, such that said breaker does not tear beverages. This avoids seal becomes leaked which further may create caking of the content and reduced its quality.

7 Claims, 2 Drawing Sheets

(56) References Cited

U.S. PATENT DOCUMENTS

| | | | | |
|---|---|---|---|---|
| 2010/0282624 | A1* | 11/2010 | Paganuzzi | B65D 51/285<br>206/222 |
| 2013/0233444 | A1* | 9/2013 | Guglielmini | B65D 51/2821<br>141/329 |
| 2015/0251837 | A1* | 9/2015 | Krammer | B65D 81/3211<br>206/222 |

* cited by examiner

COMPARTMENT FOR PREPARATION AS BOTTLE CAP OF DRINKING WATER

CROSS-REFERENCE TO RELATED APPLICATION

This application is a national application claiming priority benefit to Indonesia Patent Application SID201805578, filed on Jul. 25, 2018. The entire contents and disclosures of which are incorporated herein by reference.

TECHNICAL FIELD

Present invention relates to a compartment containing a composition as bottle cap including main compartment portion, a first seal to lock the cap with main compartment, and a breaker which moved by compartment head.

BACKGROUND OF INVENTION

Human's consumption keeps increasing and concerns more on practical aspects. Simpler methods to serve foods and beverages are also increasingly demanded. Junk food is one example of such demand. Thus, bottled beverages ease customers to bring his desired drinking anywhere.

One problem faced by customer is when he gets a beverage needs further customization. Said beverage requires additional substance to mixed up and and to drink. The additional substance may be in solid form, such as powder, or liquid.

Within this situation, customer needs to unite additional substance into single bottled beverages. Commonly, additional substance is also inside a packaging. Activity to open each packaging then mix them in a bottled beverage creates certain troubles. It is deemed not practical.

There are prior inventions providing solution for said customer need. One is Indonesia Patent application No. W00201202173 titled Kubah Terbalik untuk Mensuplai Dosis by Liquid Health Labs, Inc. discloses a universal cap to be fixed to many compartment openings with specific dimension to seal fastener. This invention also provides universal dispenser cap to house secondary supply or dosage product and while said cap dispenses specific product or secondary dosage into receiver vessel where the product or secondary dosage is attached. This innovation does not explain how to mix products inside with water.

Another innovation, Indonesia Patent application No. W00201203625 titled Kubah Terbalik untuk Mensuplai Dosis by Liquid Health Labs, Inc. discloses a cap dispensing for housing any secondary supply or dosage product and while said cap is activated to dispense secondary product or dosage into receiver vessel. It is provided also dosage or supply product. This innovation provides product mixing apparatus in a vessel with high pressure. This unease child customer or elderly.

This time, there is not beverages cap containing preparation and easy to mix up said beverages equipped with security seal and breaker with a push mechanism from rotating cap head.

SUMMARY OF INVENTION

Present invention provides a compartment as bottled beverages cap for a liquid or powder preparation which is easy to mix up with other beverages results in a liquid composition. Customer simply exchanges original bottled beverage cap with a compartment according to present invention, to expel the content into the bottle with tear-off mechanism such that they are homogenized with water, and to result in a ready-to-drink liquid composition. Further present invention provides a breaker having stopper to avoid unintentionally movement, specifically due to user's movement, so that breaker shall not tear the seal accidentally. This avoids said seal leaks and possible caking of the content which further decreases the quality.

DETAILED DESCRIPTION OF INVENTION

Figure 1:
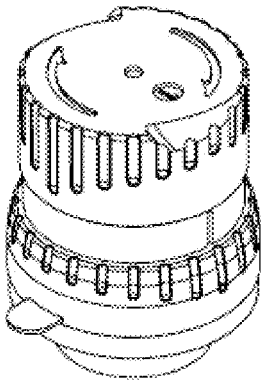
FIG. 1 shows a perspective view of example embodiment of present invention.
Figure 2:
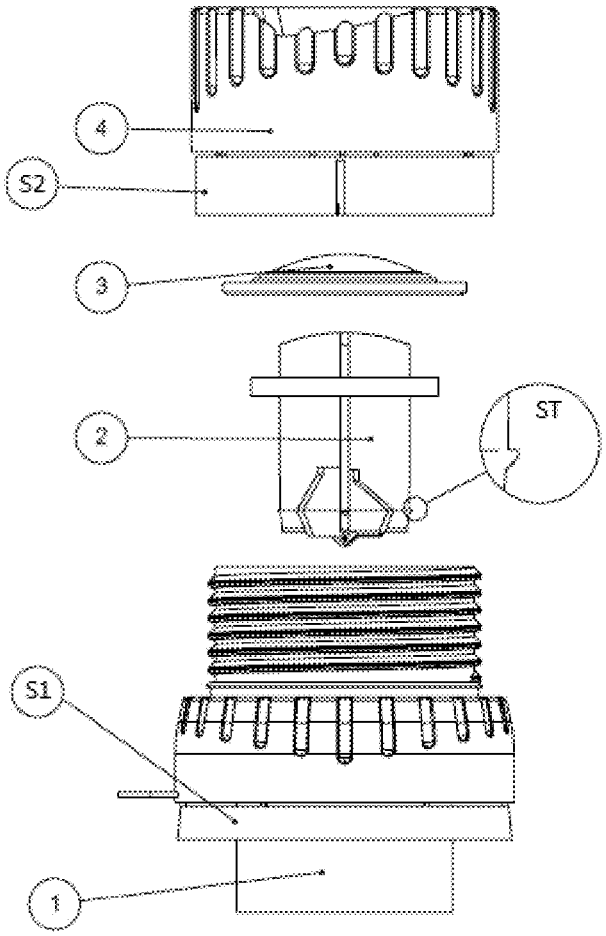
FIG. 2 shows an exploded view of compartment component according to present invention.
Figure 3:
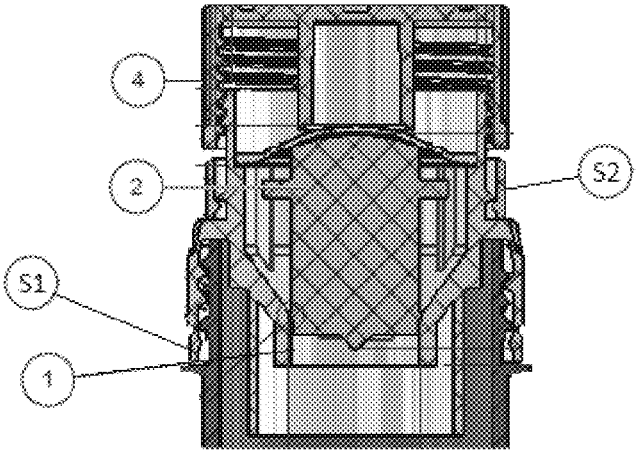
FIG. 3 shows a view of compartment component according to present invention at deployed state.
Figure 4:
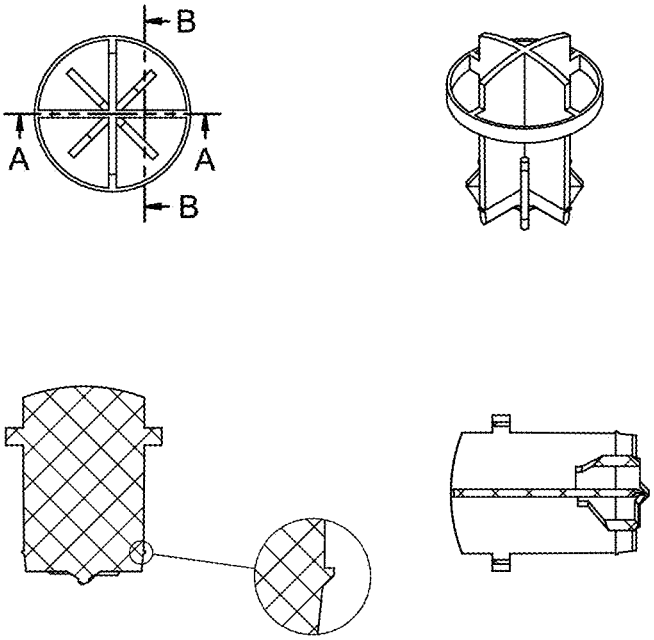
FIG. 4 shows a view of breaker according to present invention.

Next description refers to attached drawings.

Present invention provides a compartment as packed bottle cap to dispense any preparation to mix up with beverages inside to be a composition. This compartment includes a pressing portion (3) made of elastic substances, a threaded head portion (4), a second seal (S2) to cover bottom of compartment. Then said compartment according to present invention characterized with a chamber (1) to store preparation, a first seal (S1) connected to head portion (4) and separatable by rotating said head portion (4), and a breaker (2) to tear said seal (S2) when head portion (4) is downwardly rotating along thread and stopper (ST).

Further, compartment as packed bottle cap according to present invention provides a breaker (2) with configuration of eight blades.

A compartment according to present invention is made as packed bottle cap. Its shape and dimension are designed suitable to standard bottle beverages (commonly known as packed drinking water/PDW). Said head portion (4), first seal (S1), second seal (S2), chamber (1), and breaker (2) are made Polyethilene (PE). Specifically, said head portion (4) is made of High Density Poluethilene (HDPE) and the rest are Low Density Poluethilene (LDPE).

In one example embodiment, a compartment according to present invention is designed suitable with bottle beverage cap (commonly shortened as PDW). Their substances are any plastic material available in market. The shape and dimension of said compartment are any possible shapes and dimensions, as long as lower portion of the compartment is suitable to bottle's opening.

Said preparation stored inside of compartment according to present invention may be any solid or liquid preparation. The preparation term used here is not intended to limit to pharmaceutical matter, otherwise to encompass general foods/beverages. Said preparation here refers to a foods/beverage in certain state, preferably solid/powder or liquid, to be mixed with water into a solution.

A compartment according to present invention includes a pressing portion (3) made of elastic material. The material is Low Density Polyethilene (LDPE). This is chosen with considering requirement to join pressing portion (3) with chamber (1) from High Density Polyethilene (HDPE) material. It simply needs moderate elasticity so rubber material is not necessary to implement.

A compartment according to present invention includes a threaded head portion (4). Prior to use, head portion (4) is integrated to second seal (S2) by a common seal connector. This ensures said compartment unopened so the content is secured. Being used, user may rotate said head portion (4) until the seal connector is broken and second seal (S2) is separated with head portion (4). These head portion (4) and second seal (S2) may use HDPE material.

A compartment according to present invention is provided with a first seal (S1) to cover bottom of compartment. This seal functions to protect the content from ambience thus its quality is secured. Said seal is common alumunium foil sheet in this art.

Further, a compartment according to present invention provided with a chamber (1) to store preparation. The chamber is made of HDPE material to keep solid/powder or liquid preparation.

Further, a compartment according to present invention, head (4) rotates downward along thread to push-down pressing portion (3), and then to move breaker (2) to tear off said first seal (S1).

According to present invention, the breaker (2) is made of HDPE material and be configured into eight blades. This configuration is aimed to tear sufficiently first seal (S1) which is made of alumunium foil sheet.

The breaker (2) is an independent structure inside of chamber (1) and disconnected to pressing portion (3). This causes said breaker is not permanently in vertical direction and possibly said breaker moves down due to its gravitation thus tear-off first seal (S1) accidentally. To avoid this, breaker (2) is provided an auxilary minor structure (ST) or stopper which functions to against vertical movement by friction to inner wall of chamber (1).

The barrier or stopper (ST) works by friction between a protrusion on surface of breaker and surface of chamber (1). Unintentional vertical movement is vertical movement due to gravitation force to the breaker (2), or another accidentally movement. Meanwhile, when user uses bottle cap according to present invention, movement due to rotating head (4) is easily passes said stopper (ST). For this purpose, barrier or stopper (ST) is configured as protrution with 0.2-0.3 milimeter high from surface of said breaker.

Material terms here refer to common understanding in the art. Different meaning shall not deemed different material according to common understanding or standard.

What is claimed is:

1. A bottle cap for dispensing a preparation to mix with a liquid within a bottle, comprising:

a pressing portion (3) comprising an elastic substance, a threaded head portion (4), a rigid surface formed at least partially over the pressing portion (3) and configured to increase downward pressure on the pressing portion (3) upon downward rotation of the threaded head portion (4), and a first seal (S1) to cover a bottom of a compartment within the bottle cap, further comprising:

a chamber (1) to store the preparation;

a second seal (S2) connected to the head portion (4) and separable therefrom by rotating the head portion (4);

a breaker (2) to tear the first seal (S1) when the head portion (4) is downwardly rotated along the thread, wherein the pressing portion is positioned to transfer pressure from the rigid surface to the breaker (2); and a stopper (ST) for preventing unintentional vertical movement of the breaker (2).

2. The bottle cap according to claim 1, wherein further said stopper (ST) is configured as a protrusion with a height of 0.2-0.3 millimeters from a surface.

3. The bottle cap according to claim 1, wherein said breaker (2) has eight blades.

4. The bottle cap according to claim 1, wherein the bottle cap is made of any one of Polyethylene (PE), High Density Polyethylene (HDPE) and Low Density Polyethylene (LDPE).

5. The bottle cap according to claim 2, wherein the bottle cap is made of any one of Polyethylene (PE), High Density Polyethylene (HDPE) and Low Density Polyethylene (LDPE).

6. The bottle cap according to claim 1, wherein the pressing portion (3) is in communication with the head portion (4) and the breaker (2).

7. The bottle cap according to claim 6, wherein the pressing portion (3) provides elastic communication between the head portion (4) and the breaker (2) for dampened linear translation of the breaker (2) relative to rotation of the bottle cap according to a compression of the pressing portion (3).

* * * * *